US008221254B2

(12) United States Patent
Park

(10) Patent No.: US 8,221,254 B2
(45) Date of Patent: Jul. 17, 2012

(54) GOLF GLOVE

(76) Inventor: Hong Keun Park, Gwacheon-si (KR)

( * ) Notice: Subject to any disclaimer, the term of this patent is extended or adjusted under 35 U.S.C. 154(b) by 0 days.

(21) Appl. No.: 13/054,498

(22) PCT Filed: Jul. 14, 2009

(86) PCT No.: PCT/KR2009/003857

§ 371 (c)(1),
(2), (4) Date: Jan. 16, 2011

(87) PCT Pub. No.: WO2010/008178

PCT Pub. Date: Jan. 21, 2010

(65) Prior Publication Data

US 2011/0165954 A1 Jul. 7, 2011

(30) Foreign Application Priority Data

Jul. 16, 2008 (KR) ..... 10-2008-0069195

(51) Int. Cl.
*A63B 71/14* (2006.01)
*A41D 19/00* (2006.01)

(52) U.S. Cl. ..... 473/205; 473/201

(58) Field of Classification Search ..... 473/201, 473/204, 205, 206; 2/161.1, 161.2, 161.3, 2/161.4

See application file for complete search history.

(56) References Cited

U.S. PATENT DOCUMENTS 2,751,598 A * 6/1956 Romeo ..... 2/161.3
3,707,730 A * 1/1973 Slider ..... 2/161.1
3,918,097 A * 11/1975 Mlodoch ..... 2/161.1
3,930,271 A 1/1976 Kahng
3,931,647 A * 1/1976 Dien ..... 2/161.1

(Continued)

FOREIGN PATENT DOCUMENTS

JP 2005-253557 9/2005

(Continued)

OTHER PUBLICATIONS

International Search Report for PCT/KR2009/003857 mailed on Mar. 10, 2010.

*Primary Examiner* — Raleigh W. Chiu
(74) *Attorney, Agent, or Firm* — Christopher Paul Mitchell

(57) ABSTRACT

The present invention relates to a golf glove having fixing means with a loading groove arranged on a thumb portion thereof for positioning a golfer's hand on an upper portion of a golf club when gripping the club to prevent the middle and index fingers of the other hand with no glove from slipping and to fix said fingers in the loading groove, to thereby prevent the golf club from erroneously rotating and to accurately control the club during a golf swing to enable the golfer to hit a golf ball in the desired direction with ease. The fixing means has an end with an auxiliary fixing means elastically taken up on the golf club to fix the thumb portion of the glove and to enable a firm grip to be maintained. The golf glove according to one embodiment of the present invention includes: a glove body having one side wherein a thumb portion, an index finger portion, a middle finger portion, a ring finger portion, and a fifth finger portion extend, and wherein the other side has an opening for inserting a hand; as well as a fixing means extending from one side of the thumb portion, and which has one side with a loading groove.

6 Claims, 2 Drawing Sheets

U.S. PATENT DOCUMENTS

| | | | | |
|---|---|---|---|---|
| 4,643,428 | A * | 2/1987 | Churchill | 473/205 |
| 5,414,868 | A * | 5/1995 | Crawford | 2/160 |
| 5,685,787 | A * | 11/1997 | Kogut | 473/409 |
| 5,855,022 | A * | 1/1999 | Storto | 2/161.2 |
| 6,912,731 | B2 * | 7/2005 | Cass | 2/161.1 |
| 7,211,004 | B2 * | 5/2007 | DeMarco | 473/201 |
| 2010/0037363 | A1 * | 2/2010 | Oakman | 2/161.2 |
| 2011/0165954 | A1 * | 7/2011 | Park | 473/205 |

FOREIGN PATENT DOCUMENTS

| | | |
|---|---|---|
| KR | 20-0207134 | 12/2000 |
| KR | 20-0230129 | 7/2001 |

* cited by examiner

[Fig. 1]
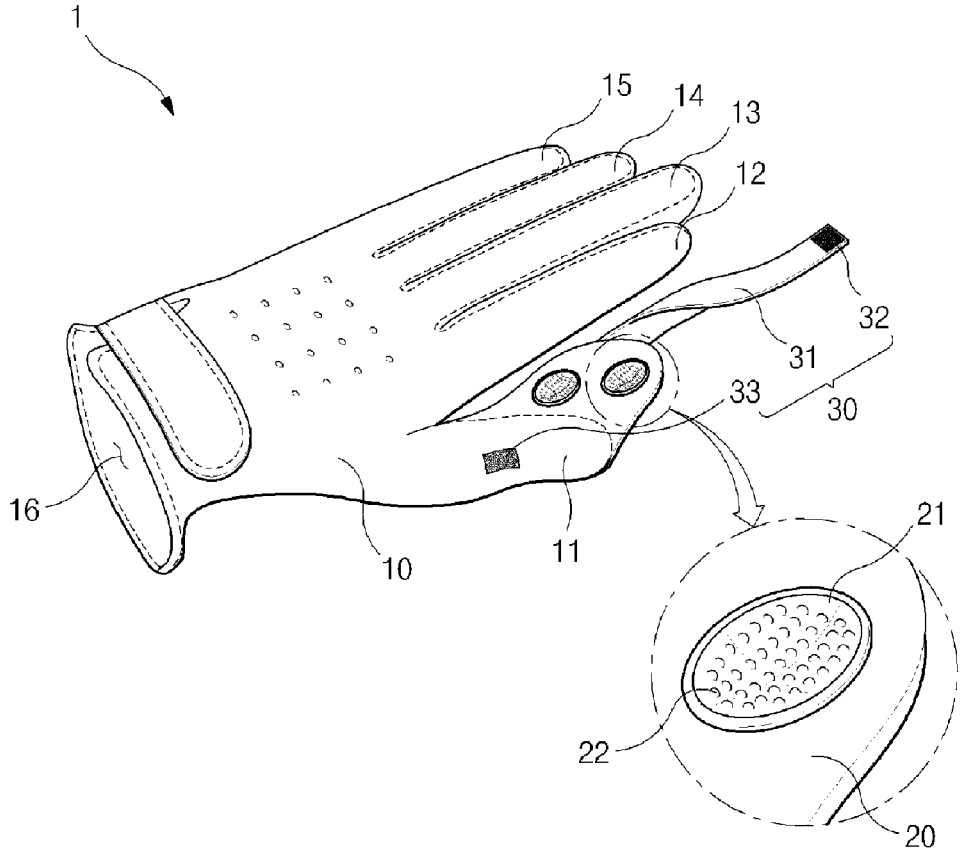
[Fig. 2]
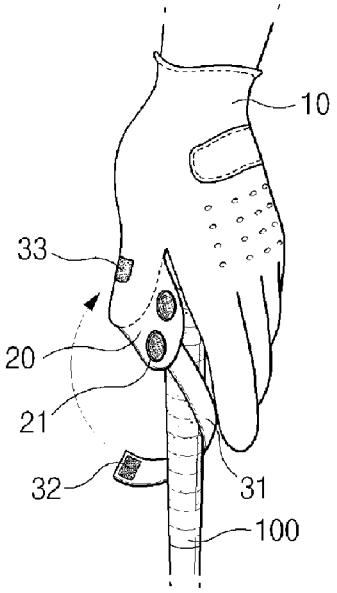

[Fig. 3]
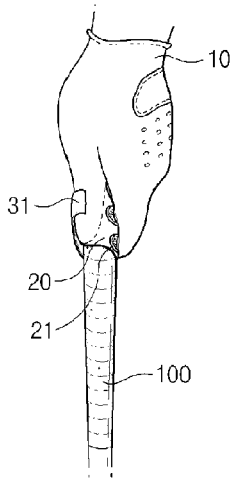
[Fig. 4]
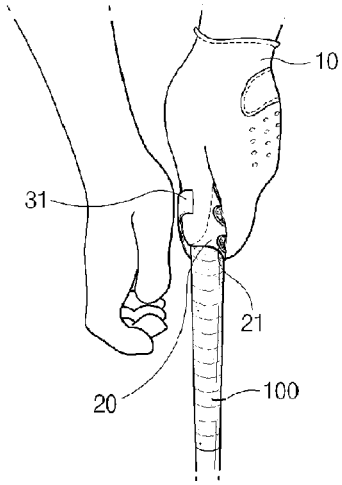
[Fig. 5]
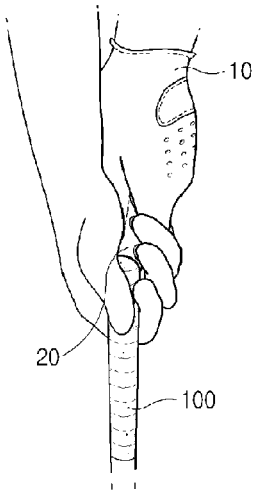

GOLF GLOVE

RELATED APPLICATIONS

This application is a 371 application of International Application No. PCT/KR2009/003857, filed Jul. 14, 2009, which in turn claims priority from Korean Patent Application No. 10-2008-0069195, filed Jul. 16, 2008, each of which is incorporated herein by reference in its entirety.

TECHNICAL FIELD

The present invention relates to a golf glove, and in particular to a golf glove which makes it possible for a golf player to make a golf ball fly further in such a manner that a fixing means having a loading groove is formed at a thumb portion of a glove worn by a hand which is placed on an upper side when griping a golf club, and a middle finger portion and an index finger portion which do not wear a golf glove are prevented from slipping in a loading groove for to thereby preventing an idle rotation of a golf club in the course of swing, and a sub-fixing means is further provided at an end of the fixing means for fixing a thumb portion because it elastically surrounds a golf club.

BACKGROUND ART

As golf becomes popular among common people, the population of golf gradually increases. Various functional golf gears are being widely developed for a user to enhance playing ability.

The golf glove among such gears is designed to prevent a grip of a golf club from being slip on a contract surface of a palm by absorbing sweat from a palm while protecting a palm by absorbing an impact in the course that a user swings holding a grip of a golf club.

A middle finger portion and a ring finger portion of a lower side are generally placed in a V-shaped space formed by a thumb portion and an index finger portion of a hand which is placed on an upper side of a golf club when holding a grip of a golf club. In case of an amateur player or a woman with a weaker griping force wear a conventional golf glove, the gripping might be loosened when a back swing reach top or in the course of release after impact, so a golf club might idle rotate, which results in an unstable control in the course of a swing.

Many of users intend to use grips which are easy to swing, giving up to a proper grip, which leads to an improper impact. So, it is impossible to make a golf ball fly further in a desired direction due to poor accuracy.

DISCLOSURE OF INVENTION

Accordingly, it is an object of the present invention to provide a golf glove which makes it possible for a golf player to make a golf ball fly further in such a manner that a fixing means having a loading groove is formed at a thumb portion of a glove worn by a hand which is placed on an upper side when griping a golf club, and a middle finger portion and an index finger portion which do not wear a golf glove are prevented from slipping in a loading groove for thereby preventing an idle rotation of a golf club in the course of swing.

It is another object of the present invention to provide a golf glove which further comprises a sub-fixing means provided at an end of the fixing means for fixing a thumb portion because it elastically surrounds a golf club for thereby obtaining a firm gripping.

TECHNICAL SOLUTION

To achieve the above objects, there is provided a golf glove, comprising a glove body having one side wherein a thumb portion, an index finger portion, a middle finger portion, a ring finger portion, and a fifth finger portion extend and the other side having an opening for inserting a hand; and a to fixing means extending from one side of the thumb portion, and which has one side with a loading groove.

A plurality of fine protrusions are protruded from an inner side of the loading groove so that a middle finger portion and a ring finger portion of a hand not wearing a glove body can be stably loaded in the loading groove in the course of holding a golf club for thereby guiding a proper gripping in the course of swing, whereby the middle finger portion and the ring finger portion do not escape from the loading groove in the course of swing.

A sub-fixing means is extended from an end of the fixing means and is elastically surrounded around the golf club and is fixed to the thumb portion.

The sub-fixing means comprises an extend portion which is extended from an end of the fixing means and is elastically surrounded around the golf club; a female Velcro tape provided at an end of the extend portion; and a male Velcro tape which is provided at the thumb portion and detachably engaged to the female Velcro tape.

EFFECTS

As described above, the golf glove according to the present invention has the following advantages. First, it possible for a golf player to make a golf ball fly further in such a manner that a fixing means having a loading groove is formed at a thumb portion of a glove worn by a hand which is placed on an upper side when griping a golf club, and a middle finger portion and an index finger portion which do not wear a golf glove are prevented from slipping in a loading groove for thereby preventing an idle rotation of a golf club in the course of swing.

Second, a sub-fixing means is further provided at an end of the fixing means for fixing a thumb portion because it elastically surrounds a golf club for thereby maintaining a firm gripping.

BRIEF DESCRIPTION OF THE DRAWINGS

The present invention will become better understood with reference to the accompanying drawings which are given only by way of illustration and thus are not limitative of the present invention, wherein;

FIG. 1 is a perspective view illustrating a golf glove according to an embodiment of the present invention; and FIGS. 2 to 5 are views of use states of a golf glove according to an embodiment of the present invention.

DESCRIPTIONS OF REFERENCE NUMERALS

| | | | |
|---|---|---|---|
| 1: | golf glove | 10: | glove body |
| 11: | thumb portion | 12: | index finger portion |
| 13: | middle finger portion | 14: | ring finger portion |
| 15: | fifth finger portion extend | 16: | opening |
| 20: | fixing means | 21: | loading groove |
| 22: | fine protrusions | 30: | sub-fixing means |
| 31: | extended portion | 32: | female Velcro tape |
| 33: | male Velcro tape | 100: | golf club |

MODES FOR CARRYING OUT THE INVENTION

FIG. 1 is a perspective view illustrating a golf glove according to an embodiment of the present invention, and FIGS. 2 to 5 are views of use states of a golf glove according to an embodiment of the present invention.

The golf glove 1 according to one embodiment of the present invention comprises a glove body 10 having one side wherein a thumb portion 11, an index finger portion 12, a middle finger portion 13, a ring finger portion 14, and a fifth finger portion extend 15, and wherein the other side has an opening 16 for inserting a hand; as well as a fixing means 20 extending from one side of the thumb portion 11, and which has one side with a loading groove 21.

Here, the glove body 10 is the same as a conventional golf glove 1 and comprises a glove body 10 having one side wherein a thumb portion 11, an index finger portion 12, a middle finger portion 13, a ring finger portion 14, and a fifth finger portion extend 15, and wherein the other side has an opening 16 for inserting a hand The glove body 10 is made of a leather material or a synthetic material like the leather material capable of generating a frictional force by which a grip does not slip in the course of swing and is equipped with a plurality of ventilation holes for easily discharging sweat.

A fixing means 20 is extended from one side of the thumb portion 11 of the glove body 10, and the fixing means 20 is equipped with a loading groove 21 in which a middle finger portion and a ring finger portion, which do not wear the glove body 10, are placed at its one side for thereby obtaining a stable gripping.

A plurality of fine protrusions 22 are formed in the loading groove 21 for obtaining a stable and proper gripping in the course of swing with a middle finger portion and a ring finger portion of a hand, which do not wear the glove body 10, being loaded when holding the golf club 100, for thereby preventing the middle finger portion and the ring finger portion from escaping from the loading groove 21 in the course of swing.

The fixing means 20 is extended from a stitched line of the thumb portion 11 toward the index finger portion 12. The position of the fixing means 20 may change to various portions by which various effects can be obtained depending on the changing position.

The loading groove 21 may be formed in a groove shape or may be formed in protruded shapes on the fixing means 20 or may be formed in through hole shapes.

The configuration is not limited. Any shape capable of stably fixing the thumb and middle finger of the other hand which does not wear the glove body 10 is possible.

A sub-fixing means 30 is further provided at an end of the fixing means 20, which is directed to more stably fixing the thumb portion 11 from which the fixing means 20 is extended.

The sub-fixing means 30 comprises an extend portion 31 which is extended from an end of the fixing means 20 and is elastically surrounded around the golf club 100, a female Velcro tape 32 provided at an end of the extend portion 31, and a male Velcro tape 33 which is provided at the thumb portion 11 and detachably engaged to the female Velcro tape 32.

The thumb portion 11 is stably fixed to the golf club 100 by means of the sub-fixing means 30, and the thumb and middle finger which do not wear the glove body 10 can be stably loaded in the loading portion of the fixing means 20 extended from the fixed thumb portion 11.

The operation of the golf glove 1 according to an embodiment of the present invention will be described.

When a user is right-handed, the user wears the glove body 10 in left hand, and when left-handed, the user wears in right hand.

The user holds the golf club 100 when the user is right-handed, the left hand wearing the glove body 10 is positioned in upper side, and the right hand not wearing the glove body 10 is positioned in lower side.

The upper side of the golf club 100 is held by means of the left hand wearing the glove body 10, and the extend portion 31 of the sub-fixing means 30 extended from the fixing means 20 is elastically surrounded around the golf club 100, and the female Velcro tape 32 formed at the end of the extend portion 31 and the male Velcro tape 33 of the thumb portion 11 are attached.

At this time, since the sub-fixing means 30 elastically surrounds the golf club 100, so the fixing means 20 is closely positioned on the golf club 100.

The right hand which does not hold the golf club 100 surrounds the lower side of the golf club 100 for thereby forming a grip. At this time, the middle and ring fingers of the right hand are positioned in the V shaped space formed between the thumb portion 11 and the index finger portion 12 of the left hand, with the middle and ring fingers being sequentially loaded into the loading groove 21 of the fixing means 20.

In the above state, a user starts swinging. At this time, since a plurality of fine protrusions 22 are protruded from the inner sides of the loading groove 21, the middle and ring fingers do not escape from the loading groove 21 at the top point of back swing or after impact or in the course of release, so it is possible to the golf club 100 from idle-rotating while obtaining an accurate control.

As the present invention may be embodied in several forms without to departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

INDUSTRIAL APPLICABILITY

As described above, the golf glove according to the present invention has the following advantages. First, it possible for a golf player to make a golf ball fly further in such a manner that a fixing means having a loading groove is formed at a thumb portion of a glove worn by a hand which is placed on an upper side when griping a golf club, and a middle finger portion and an index finger portion which do not wear a golf glove are prevented from slipping in a loading groove for thereby preventing an idle rotation of a golf club in the course of swing.

Second, a sub-fixing means is further provided at an end of the fixing means for fixing a thumb portion because it elastically surrounds a golf club for thereby maintaining a firm gripping.

The invention claimed is:

1. A golf glove, comprising:

a glove body having one side wherein a thumb portion, an index finger portion, a middle finger portion, a ring finger portion, and a fifth finger portion extend and the other side having an opening for inserting a hand; and a fixing means extending from one side of the thumb portion, and which has one side with a loading groove.

2. A golf glove according to claim 1, wherein a plurality of fine protrusions are protruded from an inner side of the loading groove so that a middle finger portion and a ring finger potion of a hand not wearing a glove body can be stably loaded in the loading groove in the course of holding a golf club for thereby guiding a proper gripping in the course of swing, whereby the middle finger potion and the ring finger portion do not escape from the loading groove in the course of swing.

3. A golf glove according to claim 2, wherein a sub-fixing means is extended from an end of the fixing means and is elastically surrounded around the golf club and is fixed to the thumb portion.

4. A golf glove according to claim 3, wherein said sub-fixing means comprises:

an extend portion which is extended from an end of the fixing means and is elastically surrounded around the golf club;

a female Velcro tape provided at an end of the extend portion; and a male Velcro tape which is provided at the thumb portion and detachably engaged to the female Velcro tape.

5. A golf glove according to claim 1, wherein a sub-fixing means is extended from an end of the fixing means and is elastically surrounded around the golf club and is fixed to the thumb portion.

6. A golf glove according to claim 5, wherein said sub-fixing means comprises:

an extend portion which is extended from an end of the fixing means and is elastically surrounded around the golf club;

a female Velcro tape provided at an end of the extend portion; and a male Velcro tape which is provided at the thumb portion and detachably engaged to the female Velcro tape.

* * * * *